US006718917B2

(12) United States Patent
Andersson et al.

(10) Patent No.: US 6,718,917 B2
(45) Date of Patent: Apr. 13, 2004

(54) TWO-STROKE INTERNAL COMBUSTION ENGINE

(75) Inventors: Lars Andersson, Vastra Frolunda (SE); Mikael Bergman, Huskvarna (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 10/065,535

(22) Filed: Oct. 28, 2002

(65) Prior Publication Data

US 2003/0029398 A1 Feb. 13, 2003

Related U.S. Application Data

(63) Continuation-in-part of application No. PCT/SE00/00789, filed on Apr. 27, 2000, now abandoned.

(51) Int. Cl.[7] ..... F02M 25/08
(52) U.S. Cl. ..... 123/73 PP; 123/73 A
(58) Field of Search ..... 123/73 R, 73 PP, 123/73 A

(56) References Cited

U.S. PATENT DOCUMENTS

| | | | |
|---|---|---|---|
| 968,200 | A | 8/1910 | Scott |
| 980,134 | A | 12/1910 | Springer |
| 1,113,456 | A | 10/1914 | McIntosh |
| 1,121,584 | A | 12/1914 | Harper, Jr. |
| 2,317,772 | A | 5/1941 | Huber et al. |
| 4,067,302 | A | 1/1978 | Ehrlich |

(List continued on next page.)

FOREIGN PATENT DOCUMENTS

| | | |
|---|---|---|
| AT | 394755 B | 11/1991 |
| DE | 420100 | 10/1925 |
| DE | 470603 | 1/1929 |
| DE | 748415 | 11/1944 |
| DE | 749456 | 11/1944 |
| DE | 2151941 | 4/1973 |
| DE | 2650834 | 6/1977 |
| DE | 3329791 A1 | 2/1985 |

(List continued on next page.)

OTHER PUBLICATIONS

F. W. Lanchester and R. H. Pearsall, The Institution Of Automobile Engineers. An Investigation of Certain Aspects of the Two–Stroke Engine For Automobile Vehicles, Feb. 1922, pp. 55–62, the Automobile Engineer.

Dr.–Ing. Kurt Blume, Gaissach, Zweitakt–Gemischspülung mit Spülvorlage, 1972, pp. 475–479, DK 621.43—144.4.058.2, Motortechnische Zeitschrift 74 (1972) 12.

(List continued on next page.)

*Primary Examiner*—Noah P. Kamen
(74) *Attorney, Agent, or Firm*—Howrey Simon Arnold and White LLP

(57) ABSTRACT

Crankcase scavenged internal combustion engine of two-stroke type (1) having at least one cylinder (15) and at least one air passage arranged between an air inlet (2) and the upper part of a number of scavenging ducts (3, 3') with exhaust orientated scavenging ports (9, 9') located close to the exhaust port (19) of the cylinder. At least one intake orientated scavenging port (14, 14') is located close to the inlet port (33) of the cylinder and is fed by at least one scavenging duct (5, 5'), and the air passage and the scavenging ducts are so arranged that the scavenging ducts (3, 3') can be supplied with and hold so much air that they during the following scavenging process will scavenge essentially nothing but air. The air passage is arranged from an air inlet (2) provided with a restriction valve (4) controlled by at least one engine parameter such as the carburetor throttle control. The intake orientated scavenging port/s (14, 14') is/are so arranged that it/they begin/s to scavenge the air and fuel-mixture (2) later than the scavenging ports (9, 9') begin to scavenge air.

30 Claims, 4 Drawing Sheets

U.S. PATENT DOCUMENTS

| | | | | |
|---|---|---|---|---|
| 4,075,985 | A | 2/1978 | Iwai | |
| 4,176,631 | A | 12/1979 | Kanao | |
| 4,248,185 | A | 2/1981 | Jaulmes | |
| 4,253,433 | A | 3/1981 | Blair | |
| 4,306,522 | A | 12/1981 | Fotsch | |
| 4,340,016 | A | 7/1982 | Ehrlich | |
| 4,481,910 | A | 11/1984 | Sheaffer | |
| 4,969,425 | A | 11/1990 | Slee | |
| 4,987,864 | A | 11/1991 | Cantrell et al. | |
| 5,379,732 | A | 1/1995 | Mavinahally et al. | |
| 5,425,346 | A | 6/1995 | Mavinahally | |
| 5,645,026 | A | 7/1997 | Schlessmann | |
| 5,857,450 | A | 1/1999 | Staerzl | |
| 6,016,776 | A | 1/2000 | Jonsson | |
| 6,085,703 | A | 7/2000 | Noguchi | |
| 6,112,708 | A | 9/2000 | Sawada et al. | |
| 6,216,650 | B1 * | 4/2001 | Noguchi | 123/73 PP |
| 6,240,886 | B1 | 6/2001 | Noguchi | |
| 6,289,856 | B1 | 9/2001 | Noguchi | |

FOREIGN PATENT DOCUMENTS

| | | | |
|---|---|---|---|
| DE | 3722424 | A1 | 1/1988 |
| DE | 19857738 | A1 | 7/1999 |
| EP | 0337768 | A2 | 10/1989 |
| EP | 0391793 | A1 | 10/1990 |
| EP | 0971110 | A1 | 1/2000 |
| EP | 0992660 | A1 | 4/2000 |
| EP | 0997620 | A2 | 5/2000 |
| FR | 784866 | | 7/1935 |
| FR | 1434710 | | 2/1966 |
| GB | 2130642 | A | 6/1984 |
| JP | 57183520 | A | 11/1982 |
| JP | 58005423 | | 1/1983 |
| JP | 07269356 | | 10/1995 |
| JP | 2000170611 | | 6/2000 |
| JP | 2000328945 | | 11/2000 |
| JP | 2000337154 | | 12/2000 |
| SE | 513 446 | C2 | 1/1999 |
| WO | 2022699 | A | 12/1979 |
| WO | WO 89 02031 | A1 | 3/1989 |
| WO | WO 98 57053 | A1 | 12/1998 |
| WO | WO 0043650 | A1 | 7/2000 |
| WO | WO 00 65209 | A1 | 11/2000 |
| WO | WO 01 25604 | A1 | 4/2001 |
| WO | WO 01 44634 | A1 | 6/2001 |

OTHER PUBLICATIONS

Prof.Dr.H.P.Lenz, Dipl.Ing.G.Bruner, Dipl.Ing. F. Gerstl, Abschlussbericht, zum Forschungsauftrag sur Entwicklung eines Ladungswechselverfahrens mit Spülvorlage für Motorfahrräder, Mar. 1978, pp. 1–16, Tables I–III, Bild 1–17, Z–NR. B0644, Institut Für Verbrennungskraftmaschinen Und Kraftfahrewsen. Technische Universität Wien.

Dipl.–Ing. Friedrich Gerstl, Dissertation, Massnahmen Zur Abgas –Und Verbrauchsverbesserung Von Kleimvolumigen Zweitakt –Ottomotoren, ausgefuhrt sum Zwecke, der Erlangung des akademischen Grades eines Doktors der technischen Wissenschaften, eingereicht an der Technischen Universitat in Wein, Aug. 1979.

J. Meyer, Air–Head Charge Stratification of a Two–Stroke Outboard Engine, Mar. 1992, The Queen's University of Belfast, School of Mechanical & Manufacturing Engineering.

Dr. R. Pischinger, $5^{TH}$ Graz Two–Wheeler Symposium, Apr. 22–23, 1993, Heft 65, Technische Universitat Graz, Mitteilungen des Institutes fur Verbrennungskraftmaschinen und Thermodynamik, Belfast, Ireland.

* cited by examiner

TWO-STROKE INTERNAL COMBUSTION ENGINE

CROSS REFERENCE TO RELATED APPLICATIONS

The present application is a continuation-in-part of International Application No. PCT/SE00/00789, filed Apr. 27, 2000 now abandoned and published in English pursuant to PCT Article 21(2). Said application is expressly incorporated herein by reference in its entirety.

BACKGROUND OF INVENTION

Internal combustion engines provided with additional air to the scavenging ducts are known. They reduce fuel consumption and exhaust emissions, but it is difficult to control the air and fuel ratio in these types of engines. Further, it can be difficult to substantially reduce the exhaust emissions utilizing these types of engine designs because uncombusted fuel may flow through the engine and out through the exhaust system as a pollutant.

In a recently published SAE-report with reference No. 2000-01-900, an engine is described of the two-stroke type. By way of check-valves, so called reed-valves, the two scavenging ducts located closest to the exhaust port are fed with so much air that it is sufficient for the whole scavenging process. One or several more scavenging ducts with ports located close to the inlet side will instead scavenge air and fuel-mixture at the same time as the other ports will scavenge air. It is pointed out that this scavenging takes place in parallel; that is, it begins at the same time and continues throughout the entire scavenging process. The principle is described as being stratified scavenging in space. Compared to a conventional two-stroke engine, the fuel consumption and exhaust emissions will be reduced. At the same time, however, it is noted that at least some of the air and fuel-mixture will be lost through the exhaust gas port at the end of the scavenging process, that is during the last 40 to 50 crank angle degrees before the exhaust gas port is closed. Obviously this loss is undesirable. Furthermore, check valves are used for feeding the scavenging ducts located close to the exhaust gas port in a known way. The flow restriction at the check valves complicates the filling of these ducts with air. These types of check valves, usually called reed-valves, however, have a number of other disadvantages. They often have a tendency to come into resonant oscillation, and can have difficulties to cope with the high rotational speeds that many two-stroke engines can reach. Besides, inclusion of the valves results in added cost and an increased number of engine components.

International Patent Application WO98/57053 shows a few different embodiments of an engine where air is supplied to the scavenging ducts via L-shaped or T-shaped recesses in the piston. Check valves are thus missing. Air is supplied to all the scavenging ducts and serves as a buffer against the subjacent air and fuel-mixture. The scavenging is thus stratified in time, but not in space in contrast to the engine mentioned above. In all embodiments, the piston recess has, where it meets the respective scavenging duct, a very limited height, which is essentially equal to the height of the actual scavenging duct. A consequence of these designs is that the passage for air delivery through the piston to the scavenging port is opened considerably later than the passage for air and fuel-mixture to the crankcase by the piston. The period for the air supply is thus significantly shorter than the period for the supply of air and fuel-mixture, where the period can be counted as crank angle or time. This can complicate the control of the total air and fuel ratio of the engine. This also means that the amount of air that can be added to each scavenging duct is significantly reduced because the underpressure driving this addition of air has decreased considerably since the inlet port has already been open during a certain period of time when the air supply has been opened. This implies that the period and the driving force for the air supply are both small. Furthermore, the flow resistance in the L-shaped and T-shaped ducts is relatively high, partly because the cross-section of the duct is small close to the scavenging port and partly because of the sharp bends created by both the L-shape or T-shape. When the air has just passed into the scavenging port, it is forced to change direction abruptly away from the lateral direction of the cylinder to instead follow the scavenging duct outwards and then downwards, i.e. two curves, each of 90 degrees and in rapid succession. This is due to the fact that the scavenging ducts of the engine are running in a radial direction to the cylinder. Each of these features contribute to increasing the flow resistance and to reducing the amount of air that can be added to the scavenging ducts, and in turn decreases the possibilities to reduce fuel consumption and exhaust emissions by means of this arrangement.

SUMMARY OF THE INVENTION

The present invention refers to a crankcase scavenged internal combustion engine of two-stroke type having at least one cylinder and at least one air passage arranged between an air inlet and the upper part of at least two scavenging ducts with scavenging ports located close to the exhaust port of the cylinder. At least one intake orientated scavenging port is located close to the inlet port of the cylinder and is fed by at least one scavenging duct or similar structure. The air passage and the scavenging ducts are so arranged that the scavenging ducts can be supplied with, and hold so much air that during the following scavenging process they will scavenge essentially nothing but air. Fresh air is thus added into the scavenging ducts located closest to the exhaust gas port and this fresh air is intended to serve as a buffer against the exhaust gas port for the air and fuel-mixture that is supplied more closely to the inlet port. It should also be pointed out that by this configuration and function, fuel consumption and exhaust gas emissions are reduced. Additionally, engines of the type disclosed herein are particularly suitable for powering handheld working tools because of their compact and lightweight nature.

In at least one embodiment, the presently disclosed invention, takes the form of an internal combustion engine characterized in that an air passage is arranged from an air inlet that may be provided with a restriction valve and that is controlled by at least one engine parameter such as the carburetor throttle control. The intake orientated scavenging port/s is/are arranged so that it/they begin to scavenge air and fuel-mixture later than the scavenging ports located adjacent to the exhaust outlet begin to scavenge air.

Since the intake oriented scavenging ports begin to scavenge the air and fuel-mixture later than the exhaust orientated scavenging ports begin to scavenge air, the air and fuel-mixture will have shorter time to reach the exhaust port. In this way the losses of the air and fuel-mixture through the exhaust port can be reduced. This is primarily achieved by at least partly filing the intake orientated scavenging ports with air or exhaust gases before the scavenging process begins. In this way, the added scavenging air will be scavenged first, which will delay the scavenging of the air and fuel-mixture. Furthermore, the air and fuel-mixture intake orientated scavenging ports can also be arranged so that their respective upper edge will be located axially lower than the corresponding edge of the other scavenging ports. This also delays the scavenging of the air and fuel mixture, but based on the action of the piston and its cooperation with the scavenging ducts.

Because at least one connecting port in the engine's cylinder wall is arranged so that it, in connection with piston positions at the top dead center, is connected with flow paths arranged in the piston, the supply of fresh air to the upper part of the scavenging ducts can be arranged entirely without check valves. This is possible because at positions at or near top dead center, there is an underpressure in the scavenging duct in comparison to the ambient air. Consequently, a piston ported air passage without any check valves can be arranged; and this is a significant advantage. Since the air supply has a very long period of time, a substantial amount of air can be added, so that a very satisfactory exhaust emission reduction rate can be achieved. Control is applied by means of a restriction valve in the air inlet, preferably controlled according to at least one engine parameter. Such a control strategy and design is a considerably less complicated solution than a variable inlet. The air inlet has preferably two connecting ports, which in one embodiment are so located that the piston covers them when in the bottom dead center position.

The restriction valve can preferably be controlled by the engine's throttling or rotational speed, alone or in combination with other engine parameters. These and other characteristic features and advantages will become more apparent from the following detailed description of various embodiments, supported by the included drawing figures.

BRIEF DESCRIPTION OF DRAWINGS

The invention will be described in closer detail in the following by way of various embodiments thereof with reference to the accompanying drawing figures. For at least some of the parts that are symmetrically located on the engine, the part on the one side has been given a numeric designation while the corresponding part on the opposite side has been given the same designation but with a prime symbol (').

DETAILED DESCRIPTION

Figure 1:
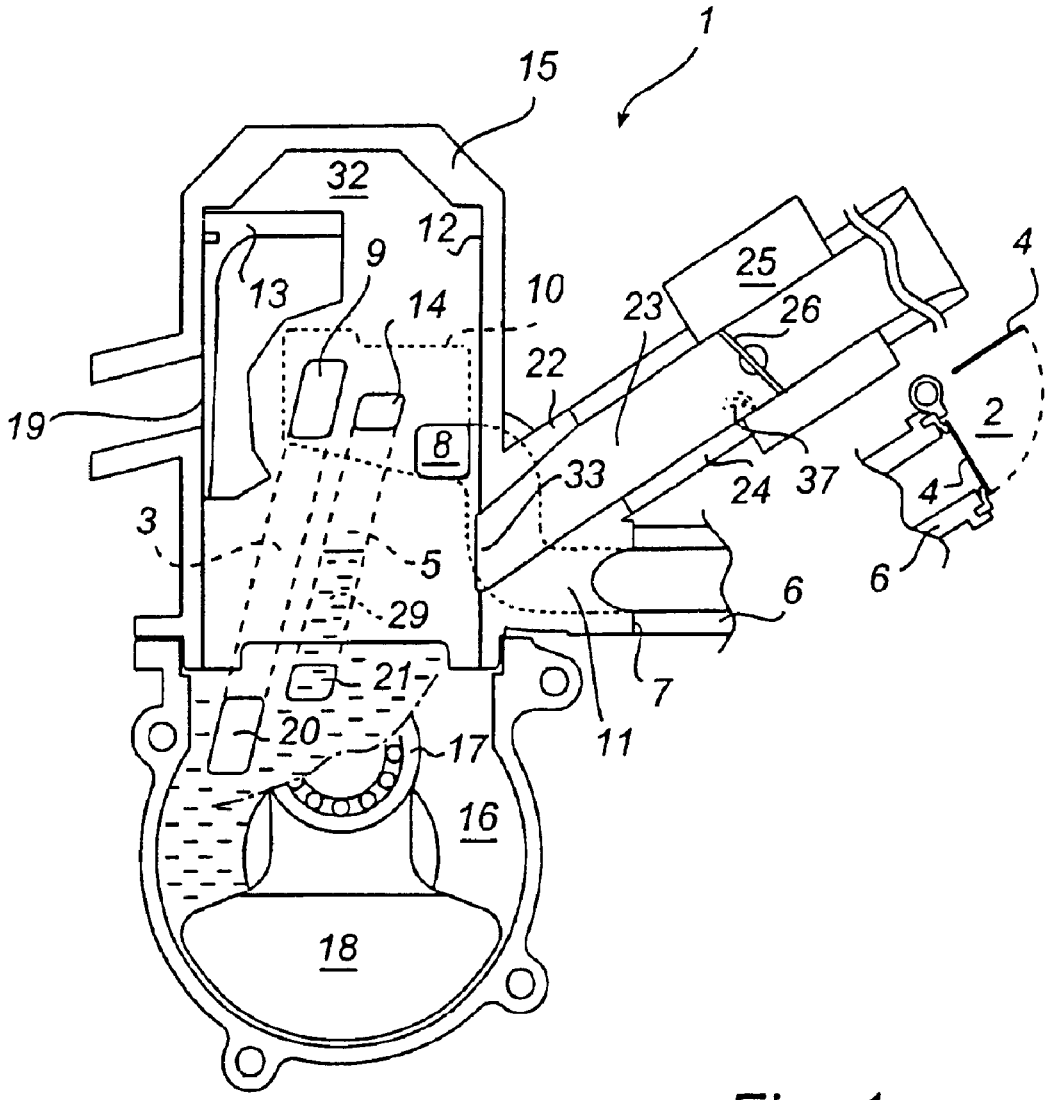
FIG. 1 is a side elevational schematic view of an engine configured according to the present invention with the piston in the top dead center position.

In FIG. 1, reference numeral 1 designates an internal combustion engine configured according to the invention. It is of the two-stroke type and has transfer or scavenging ducts 3, 3'; the latter, however, is not visible in this Figure because it is located above the plane of the paper. The transfer ducts 3, 3' have exhaust orientated ports 9,9' in the cylinder wall 12 of the engine close to the exhaust port 19 of the cylinder. The engine has a cylinder 15 and a crankcase 16, a piston 13 with a connecting rod 17 and a crank mechanism 18. Furthermore, the engine has an air and fuel-mixture inlet duct 22 with an inlet port 33 and an intermediate section 24 connected to the inlet duct, which section in turn connects to a carburetor 25 with a throttle valve 26. Fuel 37 is supplied by way of the carburetor. Usually the carburetor connects to an inlet muffler with a filter and there is an engine combustion chamber 32 having a spark plug incorporated therewith. These common-type engine features are not shown for the sake of clarity; engines of this type have, however, been described in the co-owned United States Patent Applications having application Ser. Nos. 09/952,383 and 09/483,478 which are expressly incorporated herein by reference, in their entireties, for purposes of disclosure with respect to the arrangements of the presently indicated invention(s). In a similar way, the exhaust port and muffler of the engine have not been detailed because of the familiarity of those persons skilled in this art with these devices and the arrangement for their incorporation into the types of engines that are the subject of the present disclosure.

An air inlet 2 is provided with a restriction valve 4 and is arranged so that fresh air can be supplied to the cylinder. The air inlet 2 has a connecting duct 6 leading to the; cylinder that is provided with an outer connecting port 7. Henceforth, the term connecting port should be understood to mean the port of a connection on the inside of the cylinder, while a corresponding port on the outside of the cylinder is referred to as the outer connecting port. The air inlet 2 suitably connects to an inlet muffler with a filter so that cleaned fresh air is taken in. If the engine requirements are lower and less-clean air can be accepted, this is of course not necessary. The inlet muffler is not shown for the sake of clarity.

The connecting duct 6 is thus connected to the outer connecting port 7. Advantageously, this port and following duct divides into two branches 11 that each lead to a connecting port 8. Preferably, these arrangements are located symmetrically about the cylinder 12. The outer connecting port 7 is thus located below the inlet duct 22, which provides a number of advantages such as lower intake air temperatures and a better utilization of space for a handheld working tool.

It should be appreciated, however, that the outer connecting port 7 could also be located above the inlet duct 22, which would then is oriented more horizontally. Wherever they are located, two outer connecting ports 7 can instead be used. They could then also be located on each side of the inlet duct 22. The air inlet thus leads via at least one outer connecting port 6 up to at least one connecting port 8.

Flow paths 10 are arranged in the piston so that they, in connection with piston positions at the top dead center, connect the respective connecting port 8 to the upper part of the transfer ducts 3, 3' having exhaust orientated scavenging ports 9, 9'. The flow paths 10 are formed by local recesses 10 in the piston 13. The piston is simply manufactured, usually by casting, with these local recesses 10 included at the time of original manufacture.

The flow paths also connect scavenging ducts 5, 5' with intake orientated scavenging ports 14, 14' to connecting ports 8. In FIG. 1, it is schematically illustrated how the different scavenging ducts have been filled via a scavenging air filling process before the actual scavenging process begins. Air and fuel-mixture present in, and from the crankcase, is designated by numeral reference 29. It should be observed that the air and fuel-mixture 29 reaches up to approximately half of the scavenging duct 5. Above that zone of air and fuel-mixture 29, there is scavenging air that has been fed from the air inlet 2. On the other hand, the whole scavenging duct 3 is filled with scavenging air. The purpose of this is that from the exhaust orientated scavenging ports 9, 9', during the scavenging process, the combustion chamber 32 will be fed nothing but air from the port 9, 9', which forms the air curtain (A) and serves as a buffer interiorly of the exhaust port 19. On the other hand, from the intake orientated scavenging ports 14, 14', air is first fed therefrom and then the air and fuel-mixture 29 follows during the scavenging process. In this way, the introduction of air and fuel-mixture will be delayed from the ports 14, 14', and this reduces scavenging losses in the form of the air and fuel-mixture being flushed out through the exhaust port 19 as pollutants.

As may be further appreciated from FIG. 1, the upper edge of the intake orientated scavenging port 14, 14' is also located axially lower, or closer to the crankcase than is the corresponding upper edge of the other scavenging ports 9, 9'. This can contribute to delaying the scavenging process in the scavenging port(s) oriented close to the air and fuel-mixture intake 33. If so, the scavenging of air will also be delayed, which in turn delays the scavenging of the air and fuel-mixture from the ducts 5,5'. In this case, the determining factor for this to occur is how high up the upper edge of the intake orientated scavenging port 14, 14' is located in relation to, on the one hand the exhaust orientated scavenging ports 9, 9', and on the other hand to the exhaust port 19. When the piston, in its descending motion, begins to open the exhaust port, the pressure in the combustion chamber above the piston will fall rapidly at the same time as the pressure in the crankcase 16 below the piston slowly increases.

When the piston begins to open the exhaust orientated scavenging ports 9, 9', there is a flow through each port in order to reduce the pressure difference between the combustion chamber 32 and the crankcase 16. Since the piston is moving rapidly downwards there will normally first be a small inflow of exhaust gases downward into the port, then followed by an outflow of exhaust gases and scavenging air upward through the port 14,14'. By locating the upper edge of the intake orientated scavenging port 14, 14' considerably lower than the upper edge of the exhaust orientated scavenging port, 9, 9' the scavenging through these ports, 9, 9' has already started before the intake orientated scavenging port begins to be opened by the piston.

It is important that each scavenging duct 5, 5' with respective intake orientated scavenging port 14, 14' is fed with an amount of air that during the following scavenging process will end before the amount of air in the exhaust orientated scavenging ducts 9, 9' will end. In this way, each scavenging duct 5, 5' with intake orientated scavenging port 14, 14' begins to scavenge air and fuel-mixture during the scavenging process, which is necessary to make the fuel reach the combustion chamber. The determining factors for how much air and fuel-mixture that will have time to reach the combustion chamber are, on the one hand, when the scavenging begins, which has been discussed above, and on the other hand, how much air that was fed on top of each intake orientated scavenging duct 5, 5'. The latter is determined by the flow conditions from the air inlet 2 and in through the exhaust orientated scavenging ports 9, 9' and in through the intake orientated scavenging ports 14, 14'. Since a much greater amount of air shall be supplied to the exhaust orientated scavenging ports 9, 9', this air inflow is given priority. This takes place partly due to the fact that each intake orientated, scavenging port, 14, 14' is connected later to the air inlet 2 as the piston moves toward its top dead center position. This is achieved because when the piston is located at its top dead center, the axial distance between the upper edge of the flow path 10, or the recess 10 in the piston, and the lower edge of each intake orientated scavenging port 14, 14' is less than the corresponding distance for each exhaust orientated scavenging port 9, 9'.

A priority of the air inflow to each exhaust orientated scavenging port 9,9' is also given because these ports have a larger area than the intake orientated scavenging ports 14, 14'. This is mainly achieved because the upper edge of ports, 14, 14' is located higher up than that of ports 9, 9', but it is also because the lower edge is located lower in the composition chamber 32.

Obviously, the exhaust orientated scavenging ports, 9, 9' can also be made wider than the intake orientated ports, 14, 14', however, the flow resistance in each scavenging duct has a great importance. It is therefore preferable to give precedence to a low flow resistance in the exhaust orientated scavenging ducts 3, 3'. Preferably the exhaust orientated scavenging ducts 3, 3' run away from the respective scavenging port 9, 9' essentially in the lateral direction of the cylinder; that is, essentially tangential in relation to the circumference of the cylinder wall 12. The flow thus takes place in a lateral direction with respect to the cylinder from the connecting ports 8 and across the passage 10 over to the exhaust orientated scavenging ports 9, 9', and further on in the same basic lateral direction at the top portion of each scavenging duct 3, 3'. The ducts, 3, 3' run in a lateral direction toward the exhaust side of the cylinder and then makes a soft turn down toward the crankcase where it terminates in a crankcase port 20. Such an arrangement of each scavenging duct 3, 3' is evident from U.S. patent application Ser. No. 09/952,383 which has been above-incorporated by reference.

Obviously, the respective intake orientated scavenging duct, 14, 14' can also be given this run, however, since it preferably shall have a greater flow resistance and be configured to hold so much air, the intake orientated scavenging ducts 5, 5' can instead be run down to the crankcase in the simplest of ways. FIG. 1 shows such a simple run of a closed scavenging duct 5 with crankcase port 21. However, this duct could be made even more simple by being open towards the cylinder along its entire length. It is then preferably formed as an axial groove in the cylinder wall, which can be formed directly during the die-casting process of the cylinder. When the piston is located at its top dead center, as shown in FIG. 1, it will close this groove to approximately one third of its length. In this way, air is only filled up to slightly greater than this third. Compared to a closed intake orientated scavenging duct, this is a characteristic that also provides an advantage. At certain engine running conditions, air can leak out from the bottom side of the piston so that a less varying amount of air is achieved at various engine running conditions.

The supply of air to the scavenging ducts could also be arranged by way of at least one duct, provided with a check valve, and arranged from the air inlet 2 to the upper part of the scavenging ducts 3, 3'; 5, 5'. By providing a check valve to each of the scavenging ducts 5, 5' at the intake orientated scavenging port 14, 14', with different characteristics than check valves installed at the scavenging ducts 9, 9' close to the exhaust port, 19 of the cylinder, a smaller amount of air can be supplied into the scavenging ducts 14, '. This has the same effect as described above. Preferably, the check valve belonging to the scavenging ducts 5, 5' are more stiff than the check valves belonging to the scavenging ducts 3, 3'. The stiffer of the reed-valves will open later and close earlier, and in this way the airflow is restricted.

Figure 2:
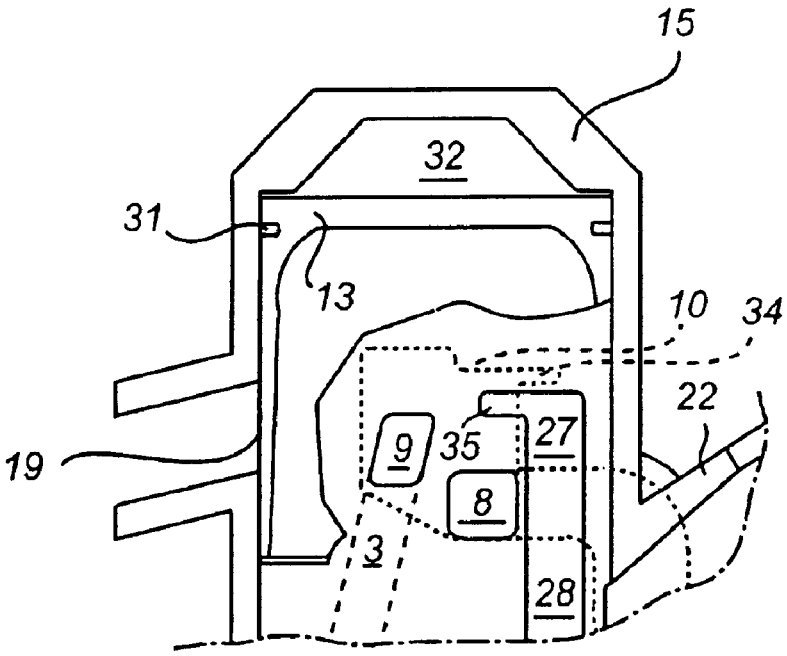
FIG. 2 is a partial side elevational schematic view showing a second embodiment of the invention that has open scavenging ducts.

In the embodiment according to FIG. 2, the scavenging duct 28 has been located to the side of the actual piston recess 10. The duct is arranged as an open scavenging duct; that is, as an axial groove in the cylinder surface 12. At the bottom dead center position, the piston's upper side is located approximately level with the upper edge of connecting port 8. The part of the open scavenging duct 28 that is located above this level is then to be considered as a scavenging port 27. In this case, two symmetrically located scavenging ducts 28 are used. It should be appreciated that the scavenging duct 5 with port 14 in FIG. 1 has a more favorable location in relation to the exhaust port 19. It is namely directed more away from the exhaust port than the scavenging port 27 in FIG. 2. Even though the scavenging duct 28 is located to the side of the actual piston recess 10, it can still be fed with scavenging air from the recess 10 at piston positions close to top dead center. Two alternative air supply systems are shown in the Figure, which also illustrates a possibility to feed exhaust gases down into the scavenging duct 28 when the piston is moving down towards its bottom dead center. The three shown solutions can be utilized either on their own or in combination of two or three.

At its top, the scavenging port 27 is provided with a protruding part or extension 35 that corresponds to the recess 10 in the piston when it is located close to its top dead center position. Thereby air can flow from connecting port 8 via the recess 10 and the protruding part 35 to the upper part of scavenging duct 28. Using a suitable dimensioning of the width of the protruding part 35 an adapted amount of air will flow to the duct 28 so that it will be filled approximately down to the bottom side of the piston 13. The protruding part 34 of the recess 10 illustrates an alternative way to supply air into the scavenging duct 28. In the shown position at the top dead center, and just before and after this, no air is supplied through the protruding part 34. Obviously this could be located lower down, but for the sake of clarity it is shown entirely above the scavenging port 27.

When the upper edge of the recess 10 comes into contact with the bottom side of connecting port 8, the protruding part 34 begins to supply air to the scavenging duct 28 and continues to do so until it runs above the duct. It will thus supply air to the upper part of the duct 28 in a similar way that the protruding part 35 does.

In FIG. 2 the upper edge of the scavenging port 27 has been extended higher up than the upper edge of the exhaust orientated scavenging duct 9. This means that the piston will open the scavenging duct 28 before it opens the scavenging duct 3. Thereby the scavenging duct 28 will sense a higher pressure and a greater downflow of exhaust gases than the scavenging duct 3 will sense.

The upper edge of the scavenging duct 28 is preferably located so high up on an axial basis that a desirable amount of exhaust gases will flow down into the scavenging duct 28. The adaptation can be such that this amount of exhaust gases alone ensures the desirable delay of the scavenging of the air and fuel-mixture through the scavenging duct 28. But it can also be such that the amount of exhaust gases completes an earlier supplied amount of air via the protruding part 35 and/or 34. Because exhaust gases are supplied when the piston is located essentially lower than at its top dead center, the open scavenging duct 28 can be filled further down by means of exhaust gases than it could have been by means of only air, since the bottom side of the piston is located lower down when the exhaust gases are supplied.

Figure 3:
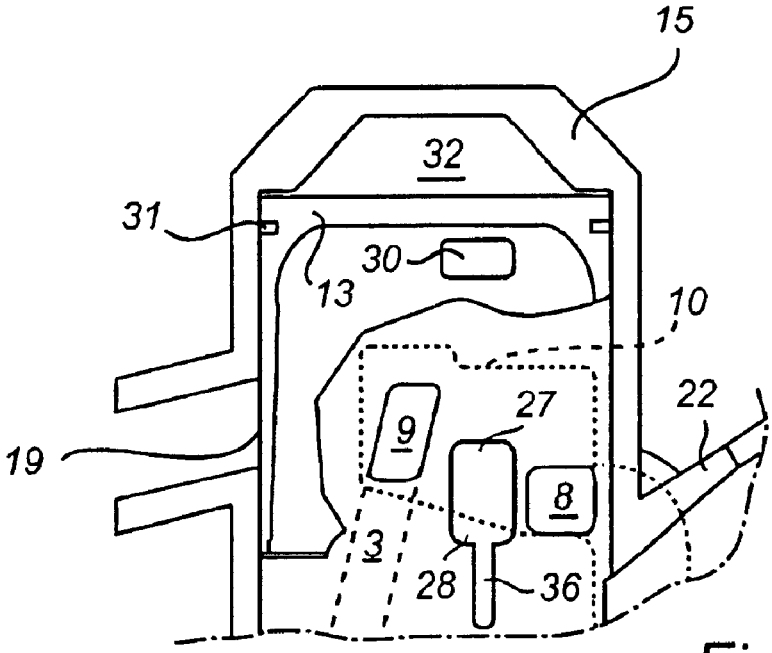
FIG. 3 is a partial side elevational schematic view showing a third embodiment of the invention having intake oriented scavenging ducts designed as recesses in the cylinder wall and that cooperate with recesses in the piston.

FIG. 3 shows an embodiment where scavenging port 27 has been given an advantageous position close to the scavenging port 9, in similarity with FIG. 1. However, this is achieved in a completely different way. At least one intake orientated scavenging port 27 with scavenging duct 28 is arranged in the form of a depression 27, 28 in the cylinder wall. In the scavenging process, this depression will cooperate with an aperture 30 in the piston so that the scavenging gases pass the piston through the aperture and the depression. When the piston is located at its top dead center, it will cover the whole depression except for a possible downwards protruding part 36. By this part, an adapted smaller amount of air and fuel-mixture and air can be drained when the piston is approaching its top dead center position. In case this down protruding part 36 is not used, this mixture will instead be left, or be carried away by the passing airflow down into the exhaust orientated scavenging duct 3. This means that at piston positions close to top dead center, the depression will probably be filled with as much air as it can take. This is, however, a very small amount of air. The main part of all air will instead fill up the scavenging ducts 3, 3' close to the exhaust port. In the scavenging process, the piston will be located so that its upper edge is approximately level with the upper edge of the connecting port 8. The aperture 30 will thereby be connected to the scavenging duct part 28 of the depression, while the upper side of the depression will serve as scavenging port 27. It should be appreciated that the upper edge of the scavenging port 27 is located considerably lower than the upper edge of scavenging port 9. This means that the scavenging process will be delayed, and then begin with a small amount of air to be followed by the air and fuel-mixture.

Figure 4:
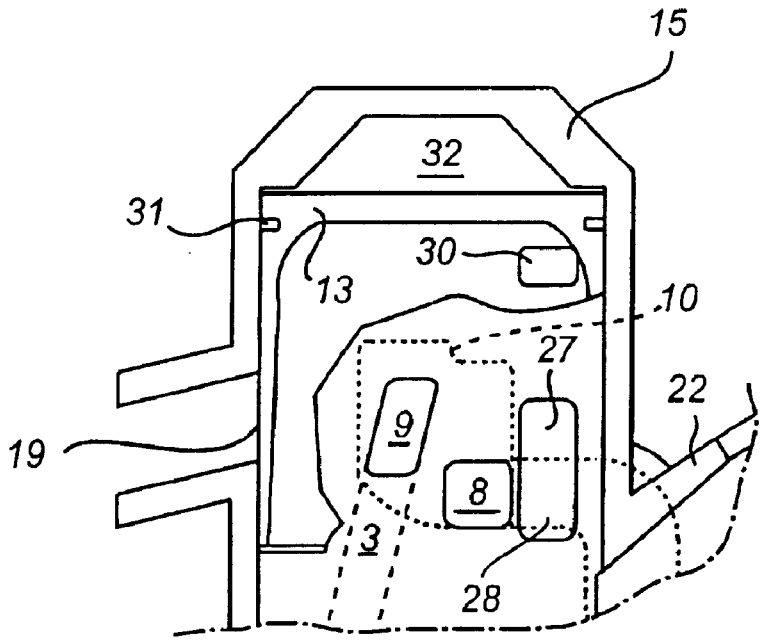
FIG. 4 shows the same type of scavenging duct as in FIG. 3, but in this case it is not fed with air.

FIG. 4 shows an embodiment where the depression 27, 28 is not fed with air from the connecting port 8. Therefore it starts to scavenge air and fuel-mixture directly when the piston begins to open the scavenging port 27. By locating the upper edge of the depression 27, 28 especially low down, a very short and late scavenging can be achieved. Possibly the upper edge of the piston can be chamfered locally in order to contribute to this. However, it should be appreciated that this is later than when the piston begins to open the scavenging port 9. The depression 27, 28 could be fed with air by the protruding parts 34, 35, 36, as shown in FIGS. 2 and 3. Its upper edge could also be adapted for filling of the depression with exhaust gases as shown in FIG. 2.

Figure 5:
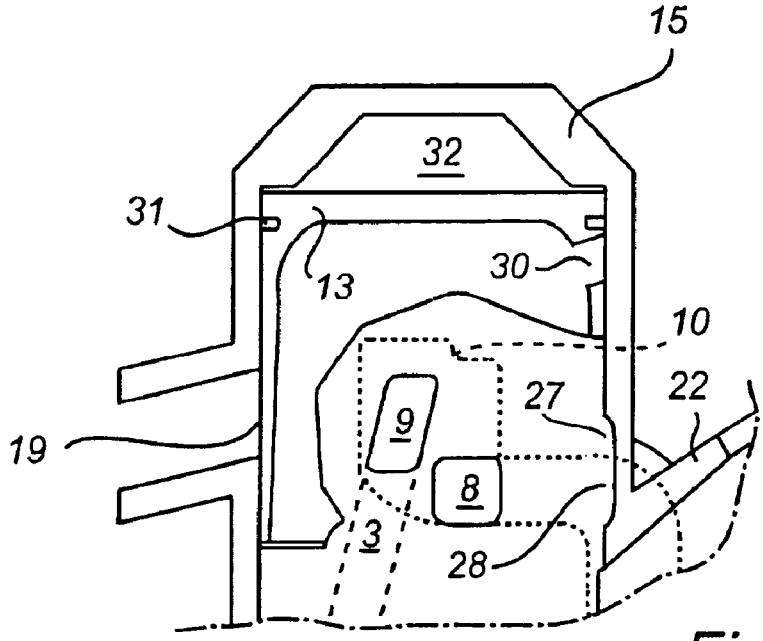
FIG. 5 illustrates and arrangement in which one scavenging duct alone is used and is therefore advantageously located directly above the engine's inlet port.

In FIG. 5, only one depression 27, 28 is used and located straight above the inlet port 33. If the piston is lowered to the position described as bottom dead center, it becomes evident how the flow can run through the aperture 30 and pass the piston through the depression 27, 28. An advantage of this embodiment is that only one depression is required, but a disadvantage is that this depression ends up opposite to the exhaust port 19, so that there is a risk that the scavenging gases will penetrate into the exhaust port earlier than in the other examples, especially those according to FIGS. 1 and 3. The depression 27, 28 can be arranged in an insert piece, which from the outside is inserted into the cylinder, and which can thereby be produced by diecasting, resulting in a cheaper cylinder. This is correspondingly valid for the examples according to FIGS. 3 and 4.

Usually the connecting ports 8 are so located in the axial direction of the cylinder that the piston covers them when located in the bottom dead center position. In this way, exhaust gases are prevented from penetrating into the connecting port and further on through a possible air filter. But it is also possible that the connecting ports 8 are located so high up that they to some extent are open when the piston is located at its bottom dead center. This is then adapted so that a desirable amount of exhaust gases will be supplied into the connecting duct 6. A highly located connecting port could also reduce the flow resistance of air at the changeover from connecting port to scavenging port 9.

Giving priority to the period of air supply from the connecting ports 8 to the exhaust orientated scavenging port 9 is important and is to a great extent determined by the flow paths in the piston, i.e. the recess 10, in the piston.

Preferably the upper edge of the recess 10 is located so high in the cylinder that when the piston is moving upwards from bottom dead center, this upper edge of the recess 10 reaches up to the lower edge of the respective exhaust orientated scavenging port 9, 9' at the same time, or earlier than the lower edge of the piston reaches up to the lower edge of the inlet port. In this way the air connection between the connecting ports 8 and the scavenging ports 9, 9' is opened at the same time as, or earlier than the inlet is opened. When the piston moves downwards again after being at top dead center, then the air connection will also be shut off at the same time or later than the inlet. Accordingly, the air supply has an essentially equally long or longer period than the mixture inlet has, counted as crank angle or time. This will reduce its flow resistance. Often it is desirable that the inlet period and the air period be essentially equally long. Preferably the air period should be 90–110% of the inlet period because both of these periods are limited by the maximum period during which the pressure is low enough in the crankcase to enable a maximal inflow.

Both periods are preferably maximized and equally long. The position of the upper edge of the recess 10 will thus determine how early the recess will come into contact with each scavenging port 9, 9' respectively. Consequently, the recess 10 in the piston that respectively meets each exhaust orientated scavenging port 9, 9' locally at this port, preferably has an axial height that is even greater than one and one-half times the height of the respective scavenging port; and even more preferably, greater than two times the height of the scavenging port. This provides that the port has a normal height so that the upper side of the piston, when located at bottom dead center, is level with the underside of the scavenging port, or is protruding one or two millimeters.

The recess is preferably downwards shaped in such a way that the connection between the recess 10 and the connecting port 8, is maximized, since it reduces the flow resistance. This means that when the piston is located at the top dead center position, the recess 10 preferably reaches so far down that it does not cover the connecting port 8 at all, as shown in FIG. 1. As a whole, this means that the recess 10 in the piston that meets each connecting port 8 at this port has an axial height that is greater than one and one-half times the height of the respective connecting port, but preferably greater than two times the height of the connecting port.

The relative axial location of the connecting port 8 and the exhaust gas orientated scavenging port 9 can be varied considerably provided that the ports are shifted sideways; that is, in the cylinder's tangential direction as shown in FIG. 1. FIG. 1 illustrates a case in which the connecting port and the scavenging port 9, 9' have an axial overlap. As shown, the upper edge of each connecting port respectively is located as high or higher in the cylinder's axial direction as the lower edge of each scavenging port. One advantage is that the two ports are more aligned with each other in an arrangement of this kind, which reduces the flow resistance when air is being transported from the connecting port to the scavenging port. Consequently, more air can be transported, which can enhance the positive effects of this arrangement such as reduced fuel consumption and exhaust emissions. For many two-stroke engines, the piston's upper side is level with the lower edge of the exhaust outlet and the lower edge of the scavenging port when the piston is at its bottom dead center position. However, it is also quite common for the piston to extend a millimeter or two above the scavenging port's lower edge. If the lower edge of the scavenging port is further lowered, an even greater axial overlap will be created between the connecting port and scavenging port. When air is supplied to the scavenging duct, the flow resistance is now reduced both due to that the ports are more level with each other and also due to the greater surface area of the scavenging port.

Above the importance of having a long period of air supply is pointed out in order to achieve a low flow resistance at the changeover between cylinder and piston. Furthermore, it is pointed out that it is an advantage for the connecting port to be located as high or higher in the cylinder's axial direction as the lower edge of each scavenging port, respectively. This provides that the connecting port/scavenging port are shifted sideways in relation to each other along the periphery of the cylinder wall. In this way, the transition from port 8 to port 9 via the piston can occur in a slightly upwards direction in relation to the cylinder's lateral direction. If the port 8 had instead been located right below port 9, then the transition would occur in a straight upwards direction. The result had been that the flow would at first turn upwards and then after reaching the scavenging port turn into a horizontal direction; in other words, two sharp turns in quick succession. Owing to the fact that the ports are shifted sideways, this enables a slightly upward flow with small turns. As mentioned, it is a significant advantage for the exhaust orientated scavenging ducts 3, 3' to be arranged essentially in the cylinder's lateral direction. The result is that the slightly upward flow from port 8 to port 9 will turn slightly and then continue in a straight lateral direction out into the transfer duct. Preferably, the transfer duct runs in the cylinder's lateral direction until it the position in the cylinder wall where a soft turn takes place, so that the transfer duct connects to the crankcase where it has its mouth 20.

Preferably each branch 11 leading to each connecting port 8 is arranged so that it is directed in the cylinder's lateral direction, or slightly upwards therefrom. In this way, an advantageous main flow direction is achieved that is arranged through the cylinder and piston. In the illustrated embodiment, each branch arrives obliquely from below from an outer connecting port 7 so that the branch first turns upwards after the outer connecting port and then continues upwards and turns into a lateral direction up to the connecting port 8 in the cylinder wall 12. At the transition from the cylinder to the piston, a slightly upward direction of the flow is created that then preferably turns slightly into a straight lateral flow direction in the transfer duct. Since the connecting port 8 must be located at a lower level than each scavenging port 9, this is a natural arrangement. But it is also possible to place one or two outer connecting ports above the inlet 22. If so, this is preferably angled more in the cylinder's lateral direction than in the shown case. In this instance, it could be arranged so that each branch 11 is directed essentially in the cylinder's lateral direction up to each connecting port 8.

From the Figures, at least one preferred flow pattern from the outer connecting port 7 to the connecting port 8 and over to the scavenging port 9 and further on into the scavenging duct 3 may be appreciated. Then it becomes apparent that the scavenging duct 3 up to the scavenging port 9 is running in an essentially tangential direction in relation to the cylinder and the same is to a great extent also valid for the first part of the branch 11 from the connecting port 8. In this way, the changes of direction will become small when the air passes from the branch 11 over to the piston recess 10 and into the scavenging duct 3.

It should be appreciated that the structures and functions illustrated in the drawings and disclosed hereinabove may be alternatively described. While different wording may be employed, different descriptions can be in parallel, one to the others via utilization of common reference numerals that refer to like structures and functions regardless of the chosen descriptive language. In order to provide clear correspondence between the appended claims and the disclosure found hereinabove and in the drawings, the following alternative description is provided regarding the subject invention(s).

From one perspective, the invention(s) described herein can be viewed as methods for providing and operating a crankcase scavenged two-stroke internal combustion engine. In one sense, the method begins with providing a cylinder 15 that defines a combustion chamber 32 and that is configured to reciprocatingly receive a piston 13 therein. The combustion chamber also includes a scavenging air supply inlet 8, an air and fuel mixture inlet 33 and an exhaust outlet 19. A fluid communication passage 10 is provided that is arranged between the scavenging air supply inlet and an inlet portion 9,9' and 14,14' of each of a plurality (two or more) of scavenging ducts 3,3' and 5,5' thereby establishing a plurality of scavenging air inlet portions, one each of the scavenging air inlet portions associated with on of the plurality of scavenging ducts. The scavenging air inlet portion to a scavenging duct can be defined as the open area of the duct across which fluid communication is effected during a scavenging air filling process due to registration of the fluid communication passage with this open area of the duct. The plurality of scavenging ducts are arranged to include at least an exhaust-side scavenging duct 3 and a mixture inlet-side scavenging duct 5 and wherein each exhaust-side scavenging duct has an exhaust-side scavenging air inlet portion 9 and the mixture inlet-side scavenging duct has a mixture inlet-side scavenging air inlet portion 14. The scavenging ducts are configured to collectively contain a sufficient amount of air to assure that substantially only air exits the engine through the exhaust outlet of the combustion chamber during a scavenging process. Further, the scavenging ducts are configured so that an air and fuel mixture (A/F) begins to be scavenged to the combustion chamber from the mixture inlet-side scavenging duct later than scavenging air (A) begins to be scavenged to the combustion chamber from the exhaust-side scavenging duct.

In an alternatively based description, the scavenging ducts 3 are referred to as exhaust-adjacent scavenging ducts, while the scavenging ducts 5 are referred to as exhaust-distant scavenging ducts. Similarly the scavenging ports 9 are referred to as exhaust-adjacent scavenging air inlet portions, while the ports 14 are referred to as exhaust-adjacent scavenging air inlet portions. This-alternative terminology has been selected to indicate that in this instance, the position of the ducts and the scavenging ports with respect to the air and fuel inlet 33 is of lesser importance than is the relative positions of especially the two ports 9,14 with respect to the exhaust outlet 19. In fact, in a most basic sense of the invention addressing the relative dispensations or scavenging air and scavenging air and fuel mixture into the combustion chamber, the relative positioning of the two ducts 3,5 is of little consequence, whereas the relative positioning of the ports 9,14 is of utmost importance with respect to the exhaust outlet.

In a further alternative, and as best appreciated in FIG. 1, sets of adjacent ports 9,14 that are placed in fluid communication by the passage 10 in the piston 13 are referred to as dual or paired ports or scavenging air inlet portions.

Figure 6:
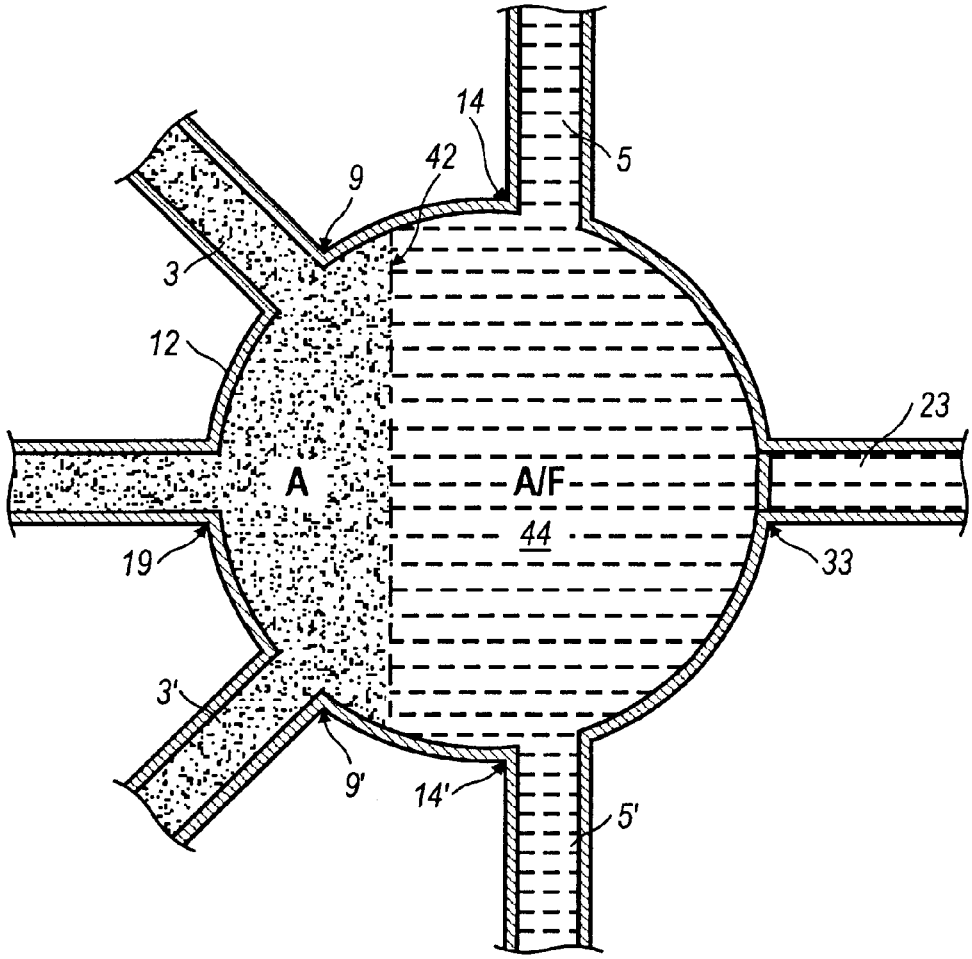
FIG. 6 is a schematic, substantially horizontal cross-sectional view, of the cylinder illustrating an exemplary air curtain (A) and stratified-in-space orientation of the air and fuel mixture (A/F) that results from a scavenging process executed according to the teachings of the present invention (s).

It is because of these relative orientations of the ports 9,14 that the air curtain (A) shown in FIG. 6 within the combustion chamber is produced adjacent to the exhaust outlet during the scavenging process. In turn, this curtain provides a fluid barrier that avoids the air and fuel mixture that is delivered to the combustion chamber out of the exhaust-distant scavenging duct during the scavenging process from entering the exhaust outlet.

A unique feature of certain embodiments of the present invention is the "layered" effect of scavenging air over the air and fuel mixture that is established in the duct feeding the scavenging port 14 and which is distanced away from the exhaust outlet during the scavenging process. As may be best appreciated in FIG. 1, this aspect, and that of assuring a barrier curtain in front of the exhaust outlet is exemplarily structurally supported by the duct's 5 having a shorter longitudinal length measured between the exhaust-distant scavenging air inlet portion 14 and an opposite opening to a crankcase of the engine than a longitudinal length of the exhaust-adjacent scavenging duct 3 measured between the exhaust-adjacent scavenging air inlet portion 9 and an opposite opening to the crankcase of the engine. As a separate or compound aspect, the scavenging duct 5 also contains a smaller volume between the exhaust-distant scavenging air inlet portion and an opposite opening to a crankcase of the engine than does the duct 3 between the exhaust-distant scavenging air inlet portion and an opposite opening to the crankcase of the engine. These disparate functions are further supported by the duct 5 having a greater resistance to fluid through-flow than is experienced through the exhaust-adjacent scavenging duct. This may be accomplished by arranging a restrictive valve in association with the duct 5; preferably in the form of reed-style valve. If reed-style valves are used, they may be associated with each of the ducts 3,5, but with different throttling characteristics as between those ducts dispensing adjacent to the exhaust outlet, and those dispensing at a distance therefrom.

The layered effect in the duct 5 is exemplarily accomplished by filling that duct with scavenging air during the scavenging air filling process and the result is that the air and fuel mixture begins to be scavenged to the combustion chamber from that duct later than scavenging air begins to be scavenged to the combustion chamber from the other duct 3 during the scavenging process.

The layered effect is also referred to as being stratified, or stratification. As shown in FIG. 1, there is caused to be formed at least a scavenging air zone and an air and fuel mixture zone, and the scavenging air zone is closer to the combustion chamber of the engine than the air and fuel mixture zone.

The provision of the air curtain (A) is also supported by the direction of a greater amount of scavenging air to the duct 3 dispensing near the exhaust outlet during the scavenging air filling process than to the exhaust-distant scavenging duct 5. This can be supported in several ways. One is to configuring the exhaust-adjacent scavenging air inlet portion 9 to be of greater size than the exhaust-distant scavenging air inlet portion 14. Another is to configuring either the exhaust-adjacent scavenging air inlet portion 9, or the duct 3 itself to have a lesser resistance to fluid flow therethrough than the exhaust-distant scavenging air inlet portion 14 or the duct 5, respectively. Similar support for the air curtain (A) is found if the exhaust-adjacent scavenging duct 3 is configured to have a greater containment volume than the exhaust-distant scavenging duct 5.

Various advantageous features in two-stroke style engines have been described in various ways hereinabove. The inventive concepts have been claimed both broadly, and more narrowly for purposes of protecting the unique aspect described herein.

What is claimed is:

1. A method for providing and operating a crankcase scavenged two-stroke internal combustion engine, the method comprising:

providing a cylinder that defines a combustion chamber and that is configured to reciprocatingly receive a piston therein, the combustion chamber further comprising a scavenging air supply inlet, an air and fuel mixture inlet and an exhaust outlet;

providing a fluid communication passage arranged between the scavenging air supply inlet and an inlet portion of each of a plurality of scavenging ducts thereby establishing a plurality of scavenging air inlet portions, one each of the scavenging air inlet portions to each of the plurality of scavenging ducts, and the scavenging air inlet portion to a scavenging duct being defined as an open area of the duct across which fluid communication is affected during a scavenging air filling process due to registration of the fluid communication passage with the open area of the duct;

arranging the plurality of scavenging ducts to include at least an exhaust-side scavenging duct and a mixture inlet-side scavenging duct and wherein each exhaust-side scavenging duct has an exhaust-side scavenging air inlet portion and the mixture inlet-side scavenging duct has a mixture inlet-side scavenging air inlet portion;

configuring the plurality of scavenging ducts to collectively contain a sufficient amount of air to assure that substantially only air exits the engine through the exhaust outlet of the combustion chamber during a scavenging process; and arranging the scavenging ducts so that an air and fuel mixture begins to be scavenged to the combustion chamber from the mixture inlet-side scavenging duct later than scavenging air begins to be scavenged to the combustion chamber from the exhaust-side scavenging duct.

2. A method for providing and operating a crankcase scavenged two-stroke internal combustion engine, the method comprising:

providing a cylinder that defines a combustion chamber and that is configured to reciprocatingly receive a piston therein, the combustion chamber further comprising a scavenging air supply inlet, an air and fuel mixture inlet and an exhaust outlet;

providing a fluid communication passage arranged between the scavenging air supply inlet and an inlet portion of each of a plurality of scavenging ducts thereby establishing a plurality of scavenging air inlet portions, one each of the scavenging air inlet portions to each of the plurality of scavenging ducts, and the scavenging air inlet portion to a scavenging duct being defined as an open area of the duct across which fluid communication is affected during a scavenging air filling process due to registration of the fluid communication passage with the open area of the duct;

arranging the plurality of scavenging ducts to at least include an exhaust-adjacent scavenging duct and an exhaust-distant scavenging duct and wherein each exhaust-adjacent scavenging duct has an exhaust-adjacent scavenging air inlet portion and the exhaust-distant scavenging duct has an exhaust-distant scavenging air inlet portion;

configuring the plurality of scavenging ducts to collectively contain a sufficient amount of air to assure that substantially only air exits the engine through an exhaust outlet of the combustion chamber during a scavenging process; and configuring the exhaust-adjacent scavenging duct differently from the exhaust-distant scavenging duct so that an air and fuel mixture begins to be scavenged to the combustion chamber from the exhaust-distant scavenging duct later than scavenging air begins to be scavenged to the combustion chamber from the exhaust-distant scavenging duct.

3. The method as recited in claim 2, further comprising:

establishing an air curtain within the combustion chamber and adjacent to the exhaust outlet during a scavenging process and thereby providing a fluid barrier that avoids the air and fuel mixture that is delivered to the combustion chamber out of the exhaust-distant scavenging duct during the scavenging process from entering the exhaust outlet.

4. The method as recited in claim 3, further comprising:

configuring the exhaust-distant scavenging duct to have a shorter longitudinal length measured between the exhaust-distant scavenging air inlet portion and an opposite opening to a crankcase of the engine than a longitudinal length of the exhaust-adjacent scavenging duct measured between the exhaust-adjacent scavenging air inlet portion and an opposite opening to the crankcase of the engine.

5. The method as recited in claim 3, further comprising:

configuring the exhaust-distant scavenging duct to contain a smaller volume between the exhaust-distant scavenging air inlet portion and an opposite opening to a crankcase of the engine than does the exhaust-adjacent scavenging duct between the exhaust-distant scavenging air inlet portion and an opposite opening to the crankcase of the engine.

6. The method as recited in claim 3, further comprising:

configuring the exhaust-distant scavenging duct to have a greater resistance to fluid flow therethrough than through the exhaust-adjacent scavenging duct.

7. The method as recited in claim 6, further comprising:

arranging a restrictive valve in association with the exhaust-distant scavenging duct thereby affecting the greater resistance to fluid flow therethrough than through the exhaust-adjacent scavenging duct.

8. The method as recited in claim 3, further comprising:

filling the exhaust-distant scavenging duct with scavenging air during the scavenging air filling process so that the arrangement of a fluid content within the exhaust-distant scavenging duct causes the air and fuel mixture to begin to be scavenged to the combustion chamber from the exhaust-distant scavenging duct later than scavenging air begins to be scavenged to the combustion chamber from the exhaust-adjacent scavenging duct during the scavenging process.

9. The method as recited in claim 8, further comprising:
executing the filling of the exhaust-distant scavenging duct with scavenging air during the scavenging air filling process so that the fluid content of the exhaust-distant scavenging duct before commencement of the scavenging process is stratified.

10. The method as recited in claim 9, further comprising:
causing the stratified content of the exhaust-distant scavenging duct to have at least a scavenging air zone and an air and fuel mixture zone.

11. The method as recited in claim 10, further comprising:
causing the scavenging air zone to be closer to the combustion chamber of the engine than the air and fuel mixture zone.

12. The method as recited in claim 3, further comprising:
directing a greater amount of scavenging air to the exhaust-adjacent scavenging duct during the scavenging air filling process than to the exhaust-distant scavenging duct.

13. The method as recited in claim 12, further comprising:
effecting the direction of a greater amount of scavenging air to the exhaust-adjacent scavenging duct during the scavenging air filling process than to the exhaust-distant scavenging duct by configuring the exhaust-adjacent scavenging air inlet portion to be of greater size than the exhaust-distant scavenging air inlet portion.

14. The method as recited in claim 12, further comprising:
effecting the direction of a greater amount of scavenging air to the exhaust-adjacent scavenging duct during the scavenging air filling process than to the exhaust-distant scavenging duct by configuring the exhaust-adjacent scavenging air inlet portion to have a lesser resistance to fluid flow therethrough than the exhaust-distant scavenging air inlet portion.

15. The method as recited in claim 12, further comprising:
effecting the direction of a greater amount of scavenging air to the exhaust-adjacent scavenging duct during the scavenging air filling process than to the exhaust-distant scavenging duct by configuring the exhaust-adjacent scavenging duct to have a lesser resistance to fluid flow therethrough than the exhaust-distant scavenging duct.

16. The method as recited in claim 12, further comprising:
effecting the direction of a greater amount of scavenging air to the exhaust-adjacent scavenging duct during the scavenging air filling process than to the exhaust-distant scavenging duct by configuring the exhaust-adjacent scavenging duct to have a lesser resistance to fluid flow therethrough than the exhaust-distant scavenging duct by associating a flow regulating valve with the exhaust-distant scavenging duct.

17. The method as recited in claim 12, further comprising:
selecting the flow regulating valve associated with the exhaust-distant scavenging duct to be of the reed valve type.

18. The method as recited in claim 12, further comprising:
effecting storage of a greater amount of scavenging air in the exhaust-adjacent scavenging duct following the scavenging air filling process than to the exhaust-distant scavenging duct by configuring the exhaust-adjacent scavenging duct to have a greater containment volume than the exhaust-distant scavenging duct.

19. The method as recited in claim 3, further comprising:
arranging the exhaust-adjacent scavenging air inlet portion so that an air and fuel mixture begins to be scavenged to the combustion chamber from the exhaust-distant scavenging duct later than scavenging air begins to be scavenged to the combustion chamber from the exhaust-distant scavenging duct.

20. The method as recited in claim 3, further comprising:
configuring the plurality of scavenging ducts so that greater fluid flow resistance is experienced in the exhaust-distant scavenging duct than in the exhaust-adjacent scavenging duct during a scavenging process.

21. The method as recited in claim 3, further comprising:
positioning the exhaust-side scavenging air inlet portion closer to the exhaust outlet of the combustion chamber than the mixture inlet-side scavenging air inlet portion.

22. The method as recited in claim 3, further comprising:
positioning the exhaust-distant scavenging air inlet portion closer to the scavenging air supply inlet in the cylinder than the exhaust-adjacent scavenging air inlet portion.

23. The method as recited in claim 3, further comprising:
providing a restriction valve in association with the scavenging air supply inlet and controlling the restriction valve based on at least one engine operating parameter.

24. The method as recited in claim 3, further comprising:
configuring the exhaust-distant scavenging air inlet portion having an upper edge located axially lower, and therefore closer to a crankcase of the engine than an upper edge of the scavenging air inlet portion paired with the exhaust-distant scavenging air inlet portion via the fluid communication passage.

25. The method as recited in claim 3, further comprising:
configuring the plurality of scavenging ducts so that the exhaust-distant scavenging duct begins to scavenge the air and fuel-mixture during the scavenging process.

26. The method as recited in claim 3, further comprising:
conveying a scavenging air supply to the scavenging air supply inlet via a connecting duct that is arranged so that when the piston is in a top dead center position, the fluid communication passage that is arranged in the piston leads scavenging air to the plurality of scavenging ducts.

27. The method as recited in claim 3, further comprising:
forming the fluid communication passage as a recess in a piston that is reciprocatingly received in the cylinder.

28. The method as recited in claim 3, further comprising:
forming the exhaust-distant scavenging duct and the exhaust-distant scavenging air inlet portion as a depression in a wall of the cylinder and configuring both to accept scavenging air during the scavenging air filling process via registration with the fluid communication passage.

29. The method as recited in claim 28, further comprising:
locating a piston for reciprocation within the cylinder and configuring the piston so that in a top dead center position, the piston covers the depression in the wall of the cylinder that forms the exhaust-distant scavenging duct and the exhaust-distant scavenging air inlet portion.

30. A method for providing and operating a crankcase scavenged two-stroke internal combustion engine, the method comprising:
providing a cylinder that defines a combustion chamber and that is configured to reciprocatingly receive a piston therein, the combustion chamber further comprising a scavenging air supply inlet, an air and fuel mixture inlet and an exhaust outlet;

providing a fluid communication passage arranged between the scavenging air supply inlet and an inlet portion of each of dual scavenging ducts;

arranging the dual scavenging ducts to include an exhaust-adjacent scavenging duct and an exhaust-distant scavenging duct and wherein each exhaust-adjacent scavenging duct;

configuring the plurality of scavenging ducts to collectively contain a sufficient amount of air to assure that substantially only air exits the engine through an exhaust outlet of the combustion chamber during a scavenging process;

configuring the exhaust-adjacent scavenging duct differently from the exhaust-distant scavenging duct so that an air and fuel mixture begins to be scavenged to the combustion chamber from the exhaust-distant scavenging duct later than scavenging air begins to be scavenged to the combustion chamber from the exhaust-distant scavenging duct; and maintaining an air curtain within the combustion chamber and adjacent to the exhaust outlet during a scavenging process and thereby providing a fluid barrier that substantially prevents the air and fuel mixture that is delivered to the combustion chamber out of the exhaust-distant scavenging duct during the scavenging process from entering the exhaust outlet.

* * * * *